US008973261B2

(12) United States Patent
Chiang

(10) Patent No.: US 8,973,261 B2
(45) Date of Patent: Mar. 10, 2015

(54) MANUFACTURING METHOD OF OBJECT HAVING CONDUCTIVE LINE

(75) Inventor: Cheng-Hung Chiang, Keelung (TW)

(73) Assignee: Getac Technology Corporation, Hsinchu County (TW)

( * ) Notice: Subject to any disclaimer, the term of this patent is extended or adjusted under 35 U.S.C. 154(b) by 275 days.

(21) Appl. No.: 13/244,562

(22) Filed: Sep. 25, 2011

(65) Prior Publication Data

US 2012/0118624 A1 May 17, 2012

(30) Foreign Application Priority Data

Nov. 15, 2010 (CN) ..... 2010 1 0555845

(51) Int. Cl.

*H01K 3/22* (2006.01)
*H01Q 1/38* (2006.01)
*H01K 3/20* (2006.01)

(52) U.S. Cl.

CPC ... *H01Q 1/38* (2013.01); *H01K 3/20* (2013.01)
USPC ..... 29/848; 29/600; 29/831; 29/846; 174/261

(58) Field of Classification Search

CPC .. B29C 43/18; B29C 45/14778; B29C 49/20; B29C 51/12; H05K 3/20; H05K 3/0058; H01Q 1/38
USPC ..... 29/600, 830, 831, 846, 848, 852; 174/261; 249/112; 264/271.1; 343/700 MS, 702, 873; 455/575.7
See application file for complete search history.

(56) References Cited

U.S. PATENT DOCUMENTS

| | | | | |
|---|---|---|---|---|
| 4,980,694 | A * | 12/1990 | Hines | 343/702 |
| 6,396,444 | B1 * | 5/2002 | Goward et al. | 29/600 |
| 7,401,758 | B2 * | 7/2008 | Liang et al. | 249/112 |
| 7,482,983 | B2 | 1/2009 | Chang et al. | |

FOREIGN PATENT DOCUMENTS

| | | | |
|---|---|---|---|
| CN | 101327632 | A | 12/2008 |
| CN | 101405915 | A | 4/2009 |
| JP | 2007196501 | A | 8/2007 |
| TW | 097108126 | | 9/2009 |
| TW | 097114949 | | 11/2009 |

* cited by examiner

*Primary Examiner* — Donghai D Nguyen

(57) ABSTRACT

A manufacturing method of an object having a conductive line includes the following steps. A hardening layer and a conductive line layer are formed in an in-mold roller (IMR) material in sequence. The conductive line layer is formed on a non-conductive substrate by an IMR process. A carrier sheet is then separated to expose the hardening layer. A connecting piece is formed on the hardening layer. The connecting piece runs through the hardening layer by a connection process, and the connecting piece is electrically connected to the conductive line layer. Therefore, an object structure having the conductive line is formed.

7 Claims, 7 Drawing Sheets

MANUFACTURING METHOD OF OBJECT HAVING CONDUCTIVE LINE

BACKGROUND OF THE INVENTION

1. Field of the Invention

The present invention relates to a manufacturing method of an object having a conductive line, and more particularly to a manufacturing method of forming a conductive line in an object by an in-mold roller (IMR) process and a structure of the object.

2. Related Art

With the rapid development of the electronics industry, especially the development of electronic products in the field of wireless communications has shown a trend of diversified designs. Light, thin, and mini electronic products become a mainstream in the market, for example, electronic products having wireless antennas such as a notebook computer, a personal digital assistant (PDA), a mobile phone, a tablet computer, and a handheld game console.

In order to make the above electronic devices light, currently, flexible printed circuit (FPC) boards are mostly used to replace conventional rigid printed circuit boards. In addition, in order to enable an electronic device having a wireless communication function to transmit data, the electronic device has to be equipped with an antenna capable of receiving and transmitting electromagnetic signals, and a signal processing circuit electrically coupled to the antenna, so as to realize the wireless communication function successfully.

Taking a notebook computer as an example, for an antenna, in addition to an original wireless communication function, the beauty appearance of the notebook computer further has to be considered, so that various designs of the antenna (for example, an inverted F-shaped antenna and a sheet-shaped antenna) shall be developed, so as to hide the antenna inside the notebook computer.

In order to further save space inside the notebook computer, and enable more electronic components to be installed inside the computer, a design of disposing the antenna on an inner side surface of a casing of an electronic device is developed.

However, the above conventional antenna is made of metal foil (for example, a copper alloy foil), and the conventional antenna has to be adhered at a preset position on an inner side surface of a casing accurately. Since a structure and a manufacturing process of the conventional antenna are too complicated, and the thickness and an overall size of the antenna are too large, the structure of an electronic device cannot be simplified or downsized, and at the same time manufacturing cost is increased.

In addition, in the prior art, an in-mold foil/film (IMF) process is already used as a technique to form a circuit layout on a casing of an electronic device. For films used in the IMF process, an ink layer is between a thin casing and a plastic. During a plastic injection molding process, an IMF film is placed in a mold, and a plastic is injected in the mold to form a plastic casing together with the film.

A following problem exists in the prior art. Three-dimensional line layout can be provided on an FPC, circuit layout on the FPC uses metal materials such as copper alloy, or an IMF is used to form a circuit, which brings difficulties during practical line layout, and makes the design of the circuit layout of the FPC too complicated.

In addition, for the IMF, the film is embedded into the casing, the process has complicated procedures, and a yield rate is not easy to be controlled, thus result in overhigh manufacturing cost and incapability of increasing production.

SUMMARY OF THE INVENTION

Accordingly, the present invention is a manufacturing method of an object having a conductive line and a structure thereof, so as to solve the problem that a casing having a complicated structure is unable to be manufactured in a conventional process of disposing an antenna at a casing of an electronic device, and procedures of an IMF process are too complicated thus causing difficulties to the control of a yield rate.

The present invention provides a manufacturing method of an object having a conductive line, and the method comprises the following steps. A hardening layer and a conductive line layer are formed on a surface of a carrier sheet in sequence. The carrier sheet, the conductive line layer, and the hardening layer form an IMR material. The conductive line layer of the IMR material is formed on a non-conductive substrate by an IMR process. The carrier sheet is then separated to expose the hardening layer. A connecting piece is formed on the hardening layer. The connecting piece runs through the hardening layer by a connection process, and the connecting piece is electrically connected to the conductive line layer.

The present invention provides a structure of an object having a conductive line, and the structure comprises a non-conductive substrate, a conductive line layer, a hardening layer, and a connecting piece. The conductive line layer is disposed on the non-conductive substrate. The conductive line layer is disposed on the non-conductive substrate through an IMR material by an IMR process. The hardening layer is disposed on the conductive line layer. The hardening layer is disposed on the conductive line layer through the IMR material by the IMR process. The connecting piece is disposed on the hardening layer. The connecting piece runs through the hardening layer, and is electrically connected to the conductive line layer.

Beneficial effects of the present invention are as follows. A conductive line layer is integrally formed in a structure of an object by an IMR process so that the object having a complicated shape and structure can be manufactured. In addition, procedures of the process of the present invention are greatly simplified, so that objects having a conductive line layer can be manufactured in large quantities continuously, and a manufacturing yield rate is increased dramatically at the same time, thus decreasing the manufacturing cost.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
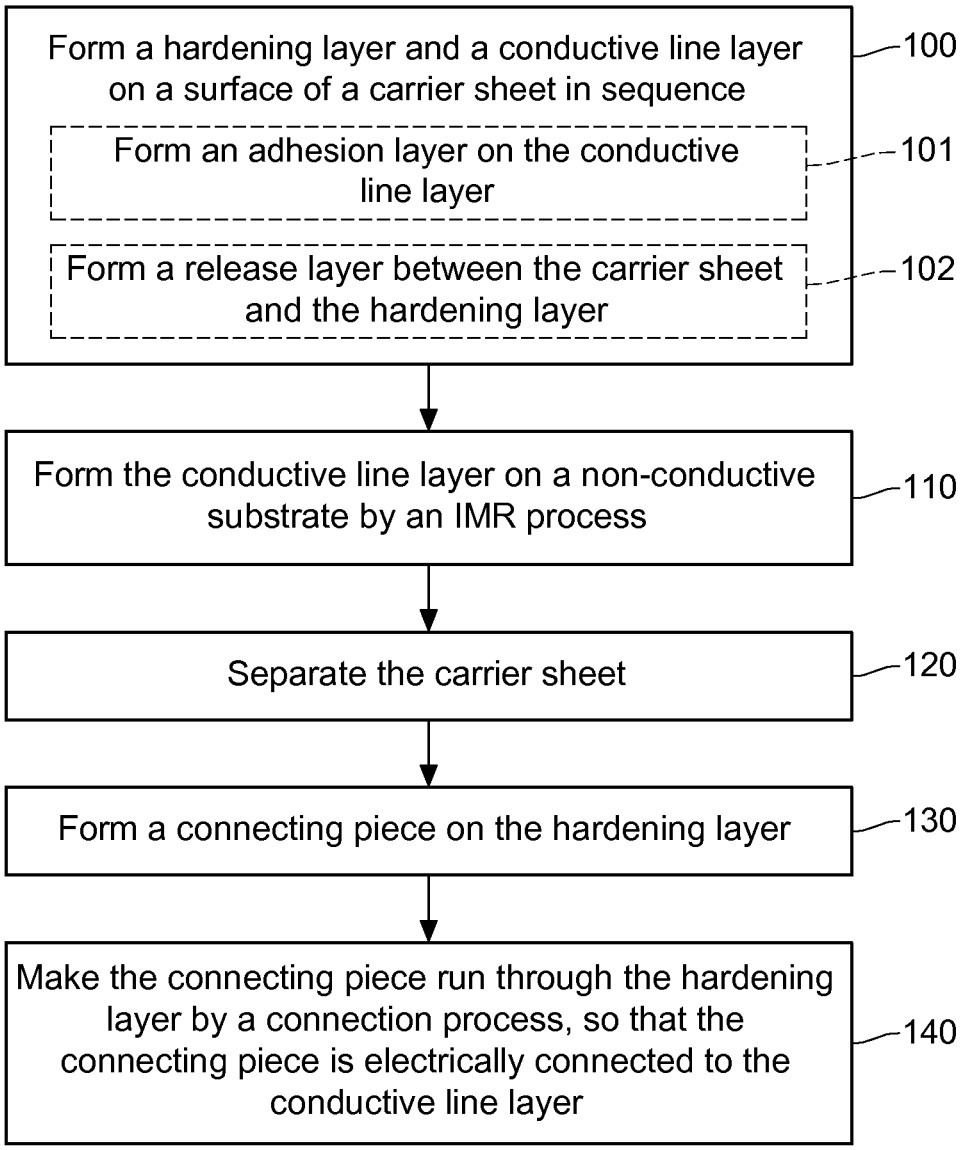
FIG. 1 is a flow chart according to a first embodiment of the present invention.

FIG. 1 is a flow chart according to a first embodiment of the present invention, and FIGS. 2A to 2D are schematic views of steps according to the first embodiment of the present invention As shown in FIG. 1 and FIGS. 2A to 2F, a manufacturing method of an object having a conductive line 200 according to the first embodiment of the present invention comprises the following steps. A film-shaped carrier sheet 210 is provided first. The carrier sheet is made of Polyethylene Terephthalate (PET), Polycarbonate (PC), Cellulose Triacetate (TAC), Acrylic (PMMA) or Cyclic Olefin Polymers (COC), but the present invention is not limited thereto.

Figure 2A:
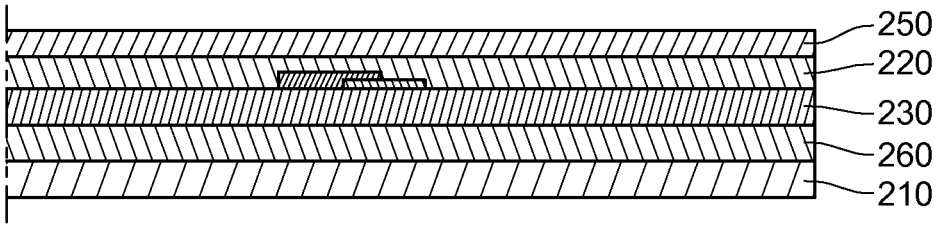
FIGS. 2A to 2F are schematic views of steps according to the first embodiment of the present invention.

Referring to FIGS. 1 and 2A, a hardening layer 230 and a conductive line layer 220 are formed on a surface of the carrier sheet 210 in sequence (Step 100). The carrier sheet 210, the conductive line layer 220, and the hardening layer 230 form an IMR material. In the present invention, the conductive line layer comprises gold, silver, copper, conductive carbon powder, silver-carbon powder, or mixed powder of carbon and graphite, so as to achieve electric conductivity.

The conductive line layer 220 provided by the present invention may be used as an antenna on a casing of an electronic device, or a circuit layout on a casing of an electronic device, but the present invention is not limited thereto. In addition, the conductive line layer 220 of the present invention may also be used as a decorative pattern on a casing of an electronic device, thus achieving a beautiful appearance.

In this embodiment, the step of forming the IMR material further comprises a step of forming an adhesion layer 250 on the conductive line layer 220 (Step 101), and a step of forming a release layer 260 between the carrier sheet 210 and the hardening layer 230 (Step 102), so as to form the IMR material.

It should be noted that, in this embodiment, the conductive line layer 220 is formed on the carrier sheet 210 by adhesion. The conductive line layer 220 may be formed on the carrier sheet 210 by hot stamping, or the conductive line layer 220 may be formed on the carrier sheet 210 by evaporation, or the conductive line layer 220 may be formed on the carrier sheet 210 by printing (for example, by screen printing), or the three adhesion methods may be used in a combined manner, so as to form the conductive line layer 220 on the carrier sheet 210.

The conductive line layer 220 of the present invention is formed on the carrier sheet 210 by using the above adhesion methods, and persons skilled in the art may also use techniques suitable for forming the conductive line layer 220 on the carrier sheet 210, which is not limited by this embodiment.

In addition, the conductive line layer 220 of the present invention is formed of at least one conductive ink, and the conductive line layer 220 according to this embodiment is formed by stacking multiple layers of conductive inks of different materials. However, persons skilled in the art may correspondingly increase or decrease the number of layers of the conductive inks of the present invention according to practical design requirements, which is not limited to this embodiment.

Figure 2B:
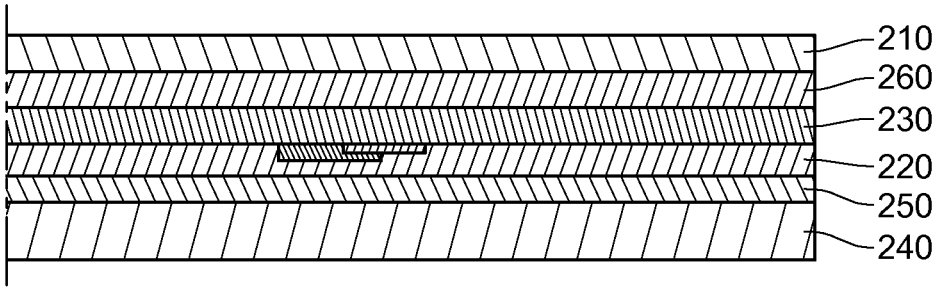

Referring to FIGS. 1 and 2B, by an IMR process, the conductive line layer 220 is formed on a non-conductive substrate 240 (Step 110). Specifically, in this embodiment, a film feeding machine places the IMR material in a mold, and the carrier sheet 210 having the IMR material is adhered to a wall of the mold. The semi-liquid non-conductive substrate 240 is injected into the mold by injection molding, so as to be cured and formed on the adhesion layer 250 of the IMR material that the non-conductive substrate 240 is formed on one side of the IMR material near the conductive line layer 220. The IMR material and the non-conductive substrate 240 are adhered to each other through a viscous force of the adhesion layer 250.

In this embodiment, the non-conductive substrate 240 is made of resin, and is formed on the conductive line layer 220 by injection molding. However, persons skilled in the art may also use other suitable forming methods or materials to replace this embodiment, so, this embodiment is not limited thereto.

Figure 2C:
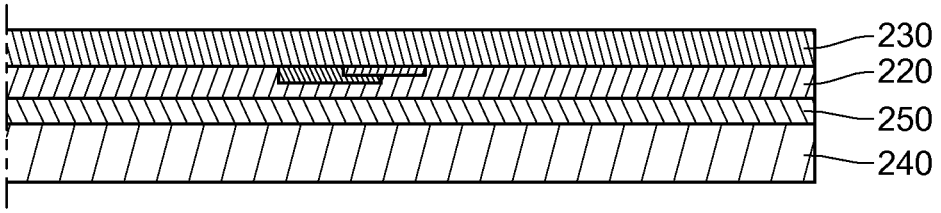
Figure 2D:
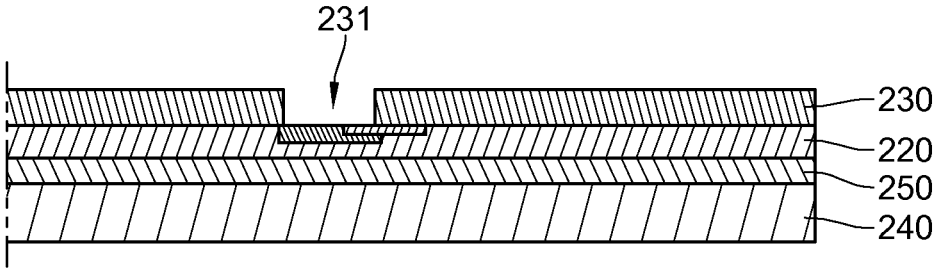
Figure 2E:
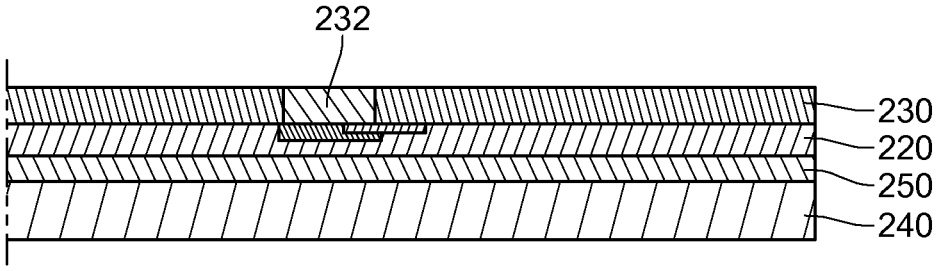

As shown in FIGS. 1 and 2C, after the non-conductive substrate 240 is cured and formed on the IMR material, the non-conductive substrate 240 and the IMR material may be taken out from the mold. At the moment, a function of the release layer 260 is that after the IMR material adhered to the non-conductive substrate 240 by the injection molding, the carrier sheet 210 may be stripped from the hardening layer 230 through the release layer 260 (Step 120). That is to say, when film stripping is performed on a product during the IMR process, the hardening layer 230 is stripped from the carrier sheet 210 through the release layer 260, and the hardening layer 230 is exposed and becomes an outside surface of the product.

It should be noted that, the IMR process according to the present invention only keeps the conductive line layer 220 inside the object 200 (that is, a casing of an electronic device), and the conductive line layer 220 and the object 200 form an integrally formed structure, which is different from an IMF process in which a whole mold film is placed in an object.

Figure 2F:
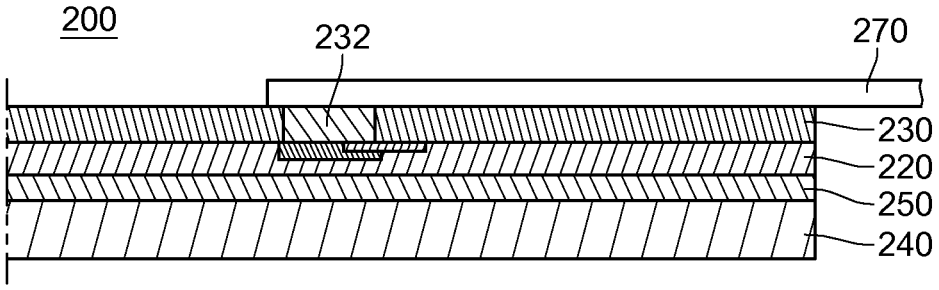
Figure 3A:
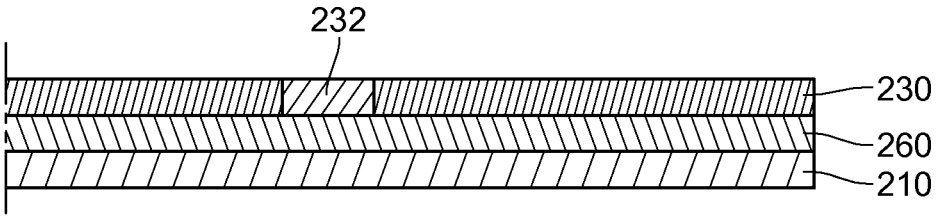
FIGS. 3A to 3D are schematic views of steps of another forming method according to the first embodiment of the present invention.
Figure 3B:
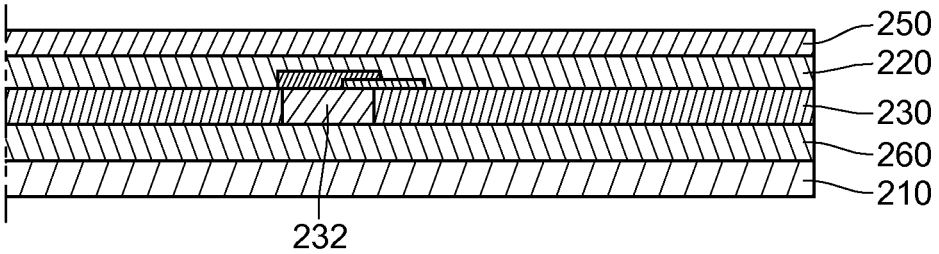
Figure 3C:
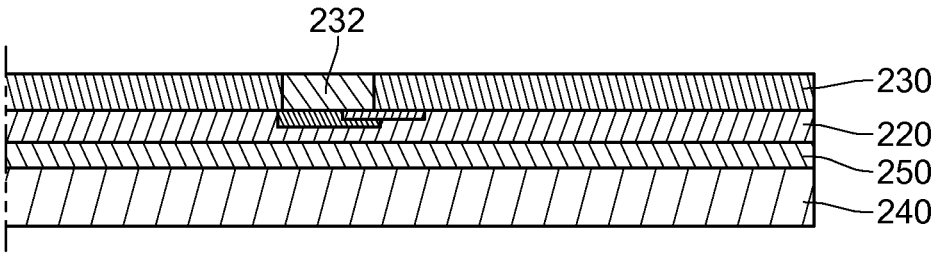
Figure 3D:
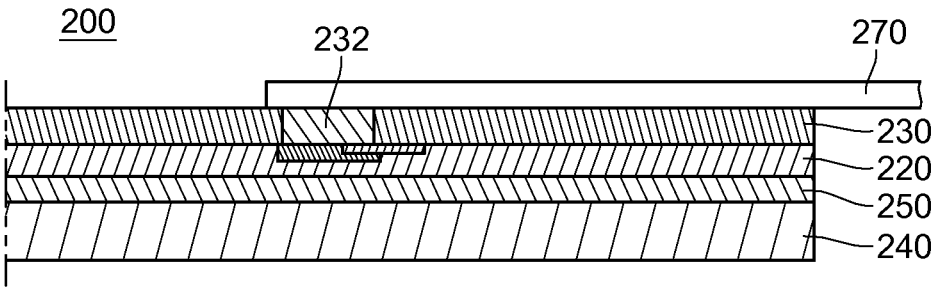

As shown in FIGS. 1 and 2F, after the step of separating the carrier sheet 210 (Step 120) is completed, a connecting piece 270 is formed on the hardening layer 230 (Step 130). By a connection process, the connecting piece 270 runs through the hardening layer 230, so that the connecting piece 270 is electrically connected to the conductive line layer 220 (Step 140).

Specifically, as shown in FIGS. 2C to 2F, in this embodiment, the hardening layer 230 may be penetrated in a direction toward the conductive line layer 220 by etching, so that the conductive line layer 220 is partially exposed through a through hole 231. A conductive material is filled into the through hole 231 to form an electrical pad 232, and the connecting piece 270 is disposed on the hardening layer 230 and contacts the electrical pad 232, so that the connecting piece 270 runs through the hardening layer 230 through the electrical pad 232, and the connecting piece 270 is therefore electrically connected to the conductive line layer 220. Therefore, the structure of the object having a conductive line 200 is formed. The connecting piece 270 and the electrical pad 232 may be electrically connected to each other by soldering, but the present invention is not limited thereto.

Alternatively, in this embodiment, for the connecting piece 270, the hardening layer 230 may be penetrated in the direction toward the conductive line layer 220 by mechanical perforation, so that the conductive line layer 220 is partially exposed through the through hole 231. Next, a conductive material is filled into the through hole 231 to form the electrical pad 232, and the connecting piece 270 is disposed on the hardening layer 230 and contacts the electrical pad 232, so that the connecting piece 270 runs through the hardening layer 230 through the electrical pad 232, and the connecting piece 270 is therefore electrically connected to the conductive line layer 220. Therefore, the structure of the object having a conductive line 200 is formed. The connecting piece 270 and the electrical pad 232 may be electrically connected to each other by soldering, but the present invention is not limited thereto.

It should be noted that, in this embodiment, the connection methods are not limited to the etching method or the mechanical perforation method, and persons skilled in the art may select any suitable chemical or mechanical method to make the connecting piece 270 run through the hardening layer 230 to be electrically connected to the conductive line layer 220.

Alternatively, as shown in FIGS. 3A to 3D, in the present invention, the connecting piece 270 and the conductive line layer 220 are electrically connected to each other by the following method. The hardening layer 230 and the electrical pad 232 are formed at the same time by an insert molding process. The electrical pad 232 is partially exposed from the hardening layer 230, the conductive line layer 220 is formed on the hardening layer 230 by the IMR process, the conductive line layer 220 contacts the electrical pad 232, the connecting piece 270 is disposed on the electrical pad 232, and the connecting piece 270 contacts the electrical pad 232, so that the connecting piece 270 runs through the hardening layer 230 through the electrical pad 232, and the connecting piece 270 is electrically connected to the conductive line layer 220. The connecting piece 270 and the electrical pad 232 may be electrically connected to each other by soldering, but the present invention is not limited thereto.

In addition, although the connecting piece 270 according to this embodiment is illustrated as a connector, the connecting piece 270 according to the present invention needs only to be an electronic component capable of transmitting an electrical signal, such as a cable or a flexible line, but the present invention is not limited thereto.

Figure 4:
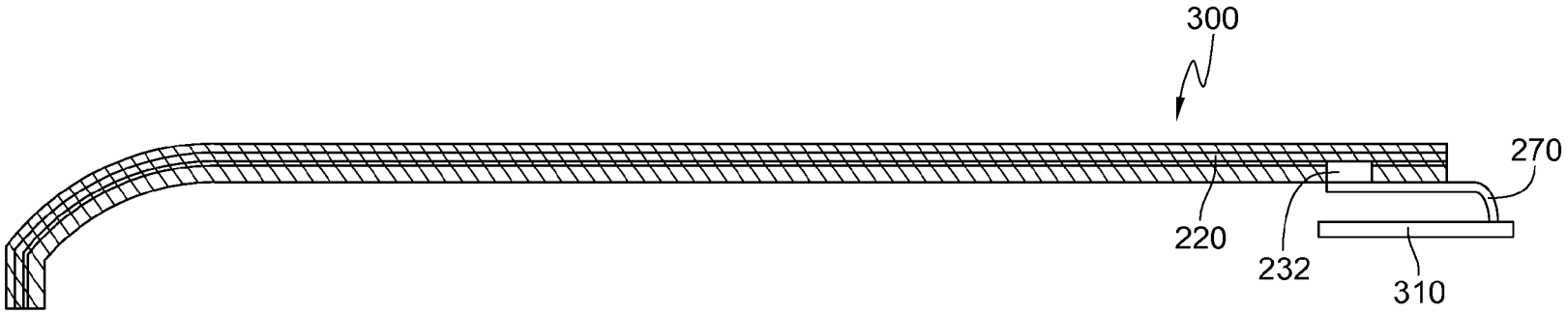
FIG. 4 is a plane side view according to the first embodiment of the present invention.

As shown in FIGS. 2F and 4, the manufacturing method of the present invention is applicable to forming a conductive line on a casing of an electronic device. When the conductive line according to the present invention is formed and disposed on an inner side surface (also called a male mold surface) of an electronic device casing 300, the connecting piece 270 is electrically connected to the conductive line layer 220 and a circuit board 310 in the electronic device casing 300 respectively, so that the conductive line layer 220 is electrically connected to the circuit board 310. Since in this embodiment, the connecting piece 270 is hidden inside the electronic device casing 300, no additional protective element is required to protect the connecting piece 270.

Figure 5:
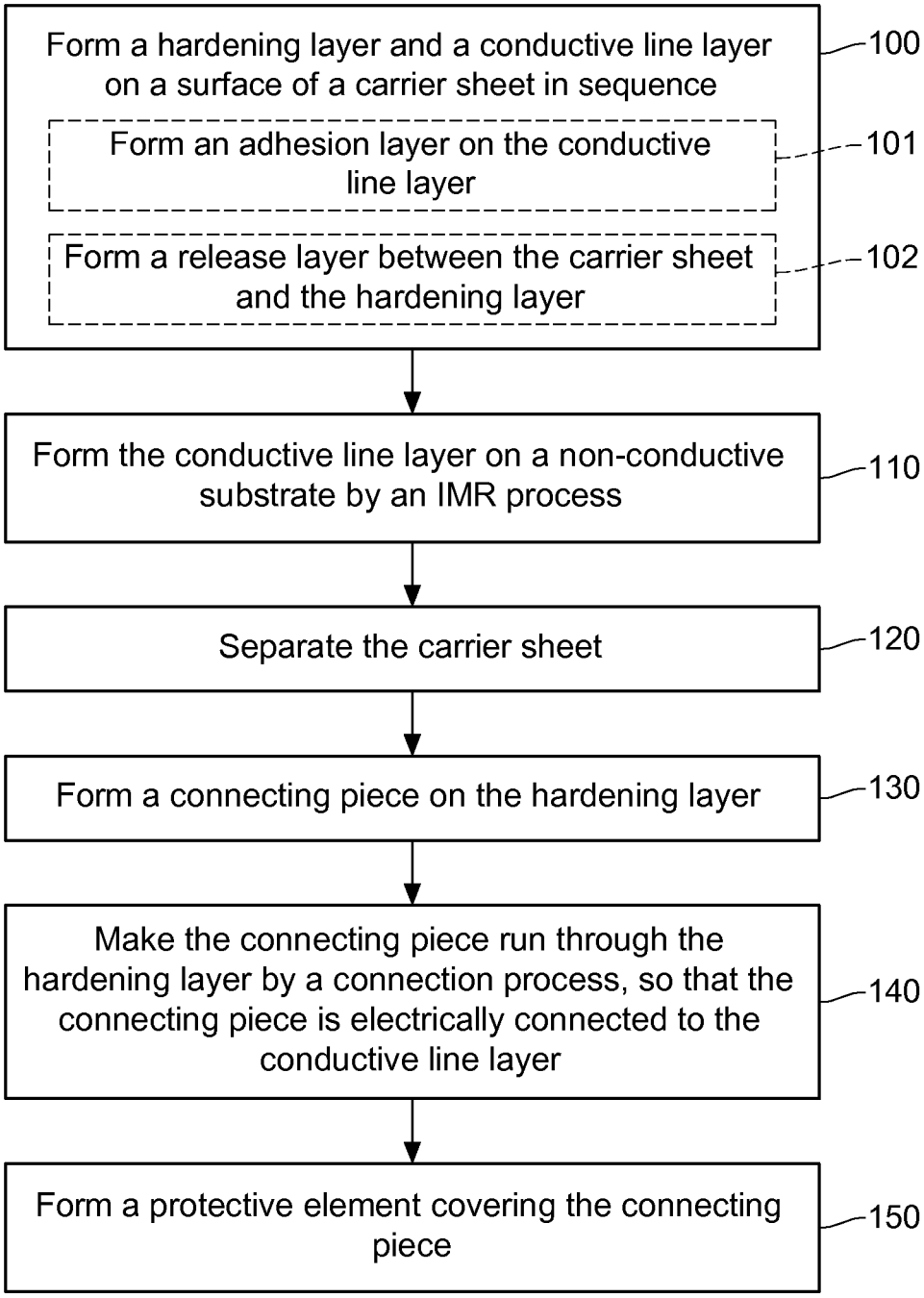
FIG. 5 is a flow chart according to a second embodiment of the present invention.
Figure 6:
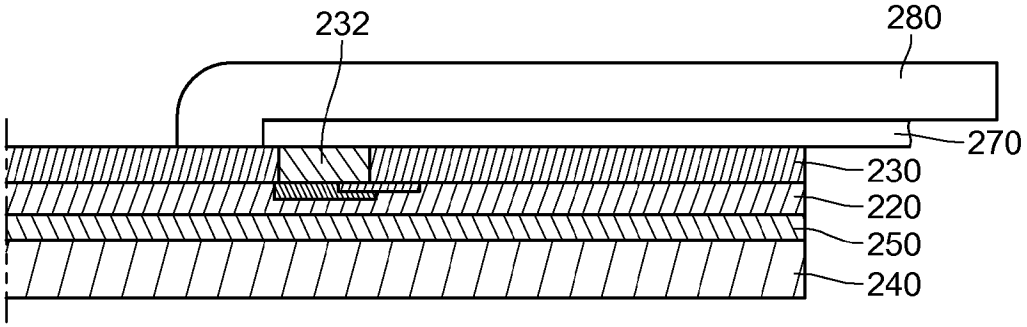
FIG. 6 is schematic sectional view according to the second embodiment of the present invention.
Figure 7:
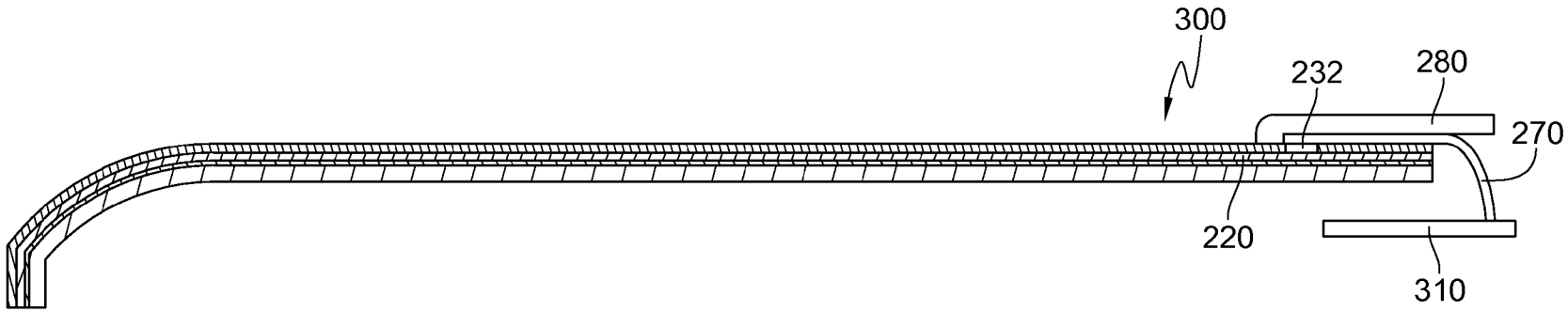
FIG. 7 is a plane side view according to the second embodiment of the present invention.

FIG. 5 is a flow chart according to a second embodiment of the present invention, FIG. 6 is schematic sectional view according to the second embodiment of the present invention, and FIG. 7 is a plane side view according to the second embodiment of the present invention. Since processing steps and a structure in the second embodiment are substantially the same as those in the first embodiment, only the differences are described herein.

As shown in FIGS. 5 and 6, after the step in which the connecting piece 270 runs through the hardening layer 230 (Step 140), the second embodiment of the present invention further comprises a step of forming a protective element 280 covering the connecting piece 270 (Step 150).

As shown in FIGS. 7, 5, and 6, the manufacturing method of the present invention is applicable to forming a conductive line on a casing of an electronic device. When the conductive line according to the present invention is formed and disposed on an outer side surface (also called a female mold surface) of the electronic device casing 300, the connecting piece 270 is electrically connected to the conductive line layer 220 and the circuit board 310 in the electronic device casing 300 respectively, so that the conductive line layer 220 is electrically connected to the circuit board 310.

Since the connecting piece 270 in this embodiment is disposed outside the electronic device casing 300 and is exposed, the protective element 280 is required to be disposed additionally for the connecting piece 270 to protect the connecting piece 270, thus preventing the connecting piece 270 from losing an electrical connection function thereof due to pollution of external dust and water.

In view of the above, in the present invention, in the manufacturing method of the object having a conductive line, the conductive line layer is integrally formed in the structure of the object (the casing of an electronic device) by the IMR process, which is very applicable to manufacturing of a casing structure having a complicated appearance. In addition, advantages of the IMR process are that the IMR process has a high degree of automation, and is capable of mass production, thus simplifying processing procedures, lowering manufacturing cost, and increasing a manufacturing yield rate.

What is claimed is:

1. A manufacturing method of an object having a conductive line, comprising the steps of:

forming a hardening layer and an electrical pad partially exposed by the hardening layer at the same time by an insert molding process;

disposing the hardening layer on a carrier sheet;

forming a conductive line layer on the hardening layer by an in-mold roller (IMR) process, wherein the conductive line layer contacts the electrical pad, and wherein the carrier sheet, the conductive line layer, and the hardening layer form an in-mold roller;

arranging the conductive line layer on a non-conductive substrate by an IMR process;

separating the carrier sheet to expose the hardening layer; and forming a connecting piece on the hardening layer, wherein the connecting piece contacts the electrical pad on a side of the hardening layer opposite to the conductive line layer.

2. The manufacturing method of the object having the conductive line according to claim 1, further comprising forming an adhesion layer on the conductive line layer, wherein the IMR material is adhered to the non-conductive substrate through the adhesion layer.

3. The manufacturing method of the object having the conductive line according to claim 1, further comprising the step of forming a release layer between the carrier sheet and the hardening layer, wherein the carrier sheet is stripped from the IMR material through the release layer.

4. The manufacturing method of the object having the conductive line according to claim 1, further comprising a step of forming a protective element covering the connecting piece.

5. The manufacturing method of the object having the conductive line according to claim 1, wherein the IMR material is placed inside a mold, and the non-conductive substrate is injected into the mold by injection molding and formed on the conductive line layer.

6. The manufacturing method of the object having the conductive line according to claim 1, wherein the conductive line layer is formed on the carrier sheet by hot stamping, evaporation or printing.

7. The manufacturing method of the object having the conductive line according to claim 1, wherein the conductive line layer is formed of at least one conductive ink.

* * * * *